United States Patent [19]

Curtis

[11] Patent Number: 4,966,129

[45] Date of Patent: Oct. 30, 1990

[54] WINDOW INSULATING DEVICE

[76] Inventor: Gregory J. Curtis, Rt. 3, Box 372F, Little Rock, Ark. 72211

[21] Appl. No.: 396,315

[22] Filed: Aug. 21, 1989

[51] Int. Cl.[5] ..... E04B 1/76

[52] U.S. Cl. ..... 126/430; 52/171; 52/204; 165/53

[58] Field of Search ..... 52/171, 202, 172, 209, 52/204, 173; 165/53; 98/99.2; 126/430, 428, 427, 422, 417

[56] References Cited

U.S. PATENT DOCUMENTS

| | | | |
|---|---|---|---|
| 2,868,943 | 1/1959 | Steele | 98/99.2 |
| 2,931,578 | 4/1960 | Thompson | 98/900 |
| 4,064,666 | 12/1977 | Kinlaw | 52/171 |

FOREIGN PATENT DOCUMENTS

| | | | |
|---|---|---|---|
| 2830745 | 1/1980 | Fed. Rep. of Germany | 52/171 |

*Primary Examiner*—John E. Murtagh
*Attorney, Agent, or Firm*—Leon Gilden

[57] ABSTRACT

A window insulating device is set forth wherein a first member telescopingly receives a second member in an interior surface of complementary configuration to the exterior surface of the second member. Each elongate member includes an inverted "J" shaped forward wall surface formed with an upper edge extending above and rearwardly of a rear edge side wall of each first and second member to provide a trough shape when the device is positioned adjacent a window and positioned upon an associated window sill. Cooled air is captured within the trough and heated prior to its ability to enter the room. To this extent, modifications include a mirrored internal surface of each of the first and second members to effect solar heating of the captured air, or alternatively may enclude a transparent envelope including a gel therewithin that is heated by solar rays and effects warming of the entrapped cold air.

1 Claim, 4 Drawing Sheets

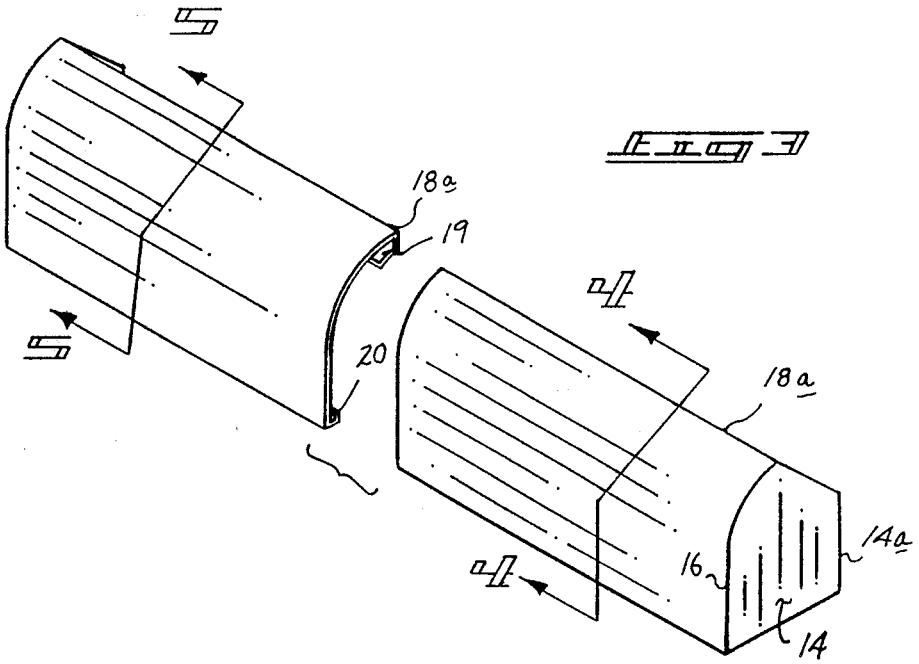
FIG. 3
FIG. 4
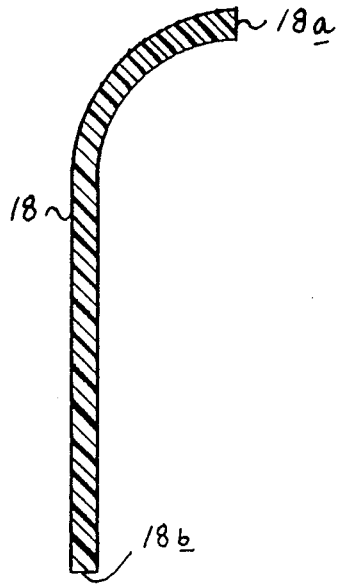

WINDOW INSULATING DEVICE

BACKGROUND OF THE INVENTION

1. Field of the Invention

The field of invention relates to insulating devices, and more particularly pertains to a new and improved window insulating device wherein the same is positioned upon an interior window sill surface adjacent a window for capturing and heating air therewithin.

2. Description of the Prior Art

The use of insulating devices associated with windows are well known in the prior art. During wintry months of lowered temperatures, air within a dwelling is rapidly cooled in its contact with associated windows. The cool air descends and enters the room to effect a cooling of the room at an accelerated rate. Various storm type windows and the like have been utilized to minimize such heat transfer but nonetheless, the cooling effect continues and persists within dwellings. The prior art has utilized various attempts to minimize such cooling effects and to this extent is exemplified by the following patents:

U.S. Pat. No. 4,423,574 to Pierre sets forth a panel overlying thermal openings comprising insulating opaque material of a dimension greater than of an opening to be covered to effect an air-tight seal therebout.

U.S. Pat. No. 4,326,360 to Davidson sets forth a thermal sealing device for overlying securement to a window to effect a thermal sealing about the window to reduce heat transfer therethrough.

U.S. Pat. No. 3,943,662 to La Rosa provides for an insulated triangulated bridge member to overlie a window structure in abutment with wall portions about an associated casement window to minimize heat transfer therethrough.

U.S. Pat. No. 3,908,730 to Goss provides a storm window organization utilizing plural layers of windows and sash members to minimize heat transfer through the associated window.

U.S. Pat. No. 3,861,081 to Maskell sets forth a flood barrier for use overlying doorways and the like to prevent water to enter through doorways of associated dwellings.

As such, it may be appreciated that there is a continuing need for a new and improved window insulating device wherein the same addresses both the problems of ease of use and effectiveness in construction, and in this respect, the present invention substantially fulfills this need.

SUMMARY OF THE INVENTION

In view of the foregoing disadvantages inherent in the known types of insulated window coverings now present in the prior art, the present invention provides an insulated window device wherein the same utilizes a trough-like member positioned adjacent a window in immediate frame portions of the window and overlying a sill to capture and heat cooled air within the device. As such, the general purpose of the present invention, which will be described subsequently in greater detail, is to provide a new and improved insulated window device which has all the advantages of the prior art insulated window devices and none of the disadvantages.

To attain this, the present invention includes a first elongate member telescopingly receiving a second elongate member complementarily therewithin. The members each include an end wall formed with a rear vertical edge spaced from a forward, generally inverted "J" shaped arcuate edge spaced above the rear edge to provide a trough to capture cooled air when the device is positioned adjacent a window surface overlying an interior window sill structure. Heating of the captured air is effected to elevate its temperature and minimize cooling of an associated dwelling. Modifications include an internal mirrored surface, or alternatively a transparent flexible envelope containing a liquid gel therewithin to effect solar heating of the captured air and enhance its rate of heating.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window insulating device which has all the advantages of the prior art window insulating devices and none of the disadvantages.

It is another object of the present invention to provide a new and improved window insulating device which may be easily and efficiently manufactured and marketed.

It is a further object of the present invention to provide a new and improved window insulating device which is of a durable and reliable construction.

An even further object of the present invention is to provide a new and improved window insulating device which is susceptible of a low cost of manufacture with regard to both materials and labor, and which accordingly is then susceptible of low prices of sale to the consuming public, thereby making such window insulating devices economically available to the buying public.

Still yet another object of the present invention is to provide a new and improved window insulating device which provides in the apparatuses and methods of the prior art some of the advantages thereof, while simultaneously overcoming some of the disadvantages normally associated therewith.

Still another object of the present invention is to provide a new and improved window insulating device wherein the same provides a trough structure for capturing cooled air adjacent a window structure prior to its cooling of an associated environment adjacent a window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the invention in an exploded configuration.

FIG. 4 is an orthographic view taken along the lines 4—4 of FIG. 3 in the direction indicated by the arrows.

DESCRIPTION OF THE PREFERRED EMBODIMENT

Figure 1:
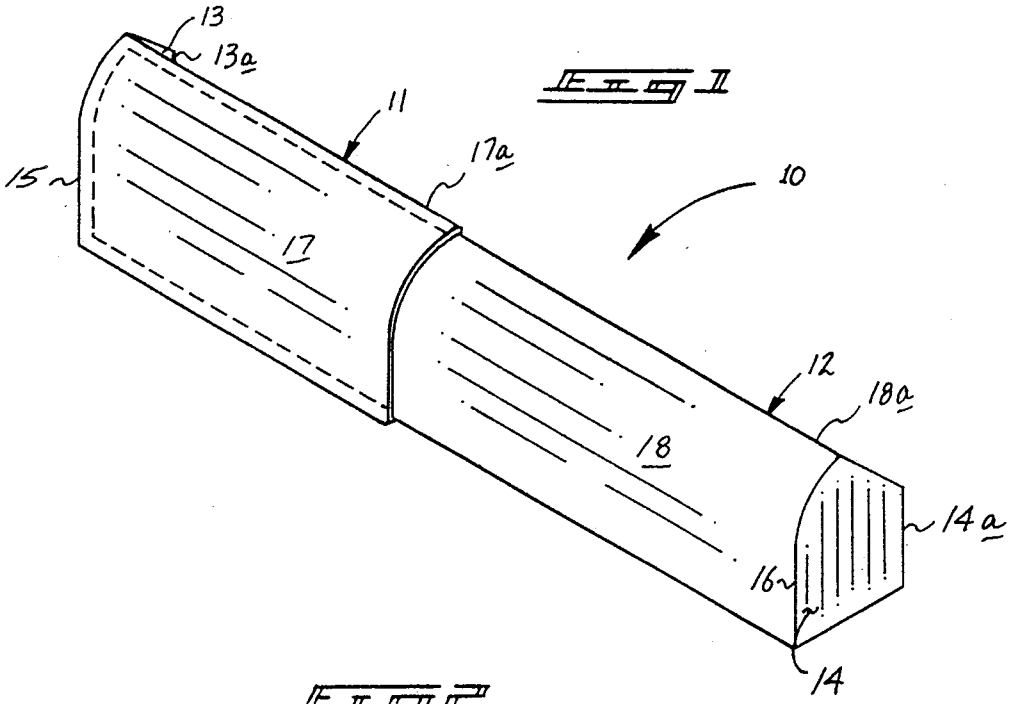
FIG. 1 is an isometric illustration of the instant invention.
Figure 2:
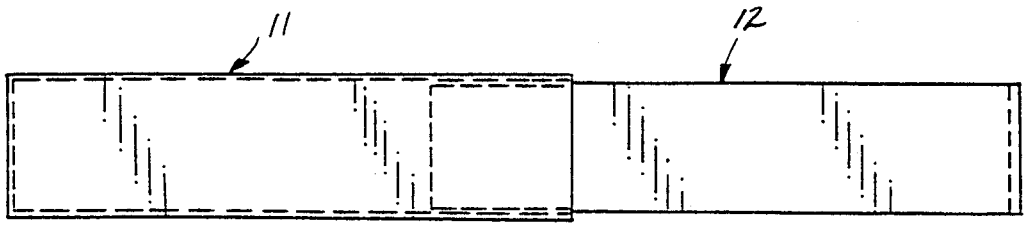
FIG. 2 is a frontal orthographic view taken in elevation of the instant invention.
Figure 5:
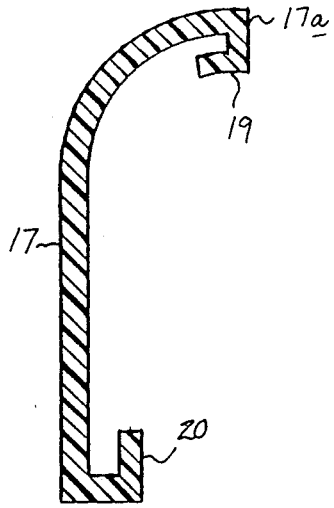
FIG. 5 is an orthographic view taken along the lines 5—5 of FIG. 3 in the direction indicated by the arrows.

With reference now to the drawings, and in particular to FIGS. 1 to 8 thereof, a new and improved window insulating device embodying the principles and concepts of the present invention and generally designated by the reference numerals 10, 10*a*, and 10*b* will be described.

Figure 6:
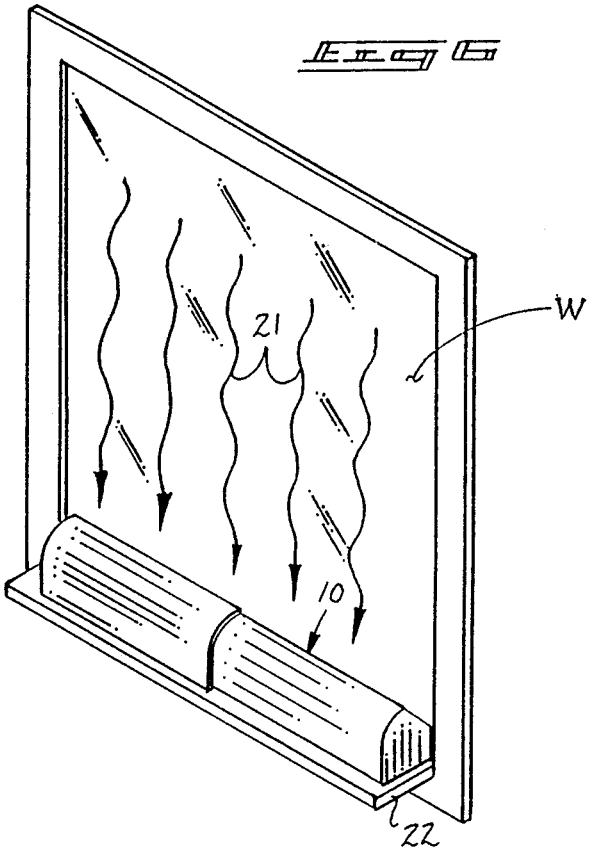
FIG. 6 is an isometric illustration of the instant invention positioned in cooperation with an associated window.

More specifically, the window insulating device 10 essentially comprises a first elongate member 11 telescopingly receiving a second elongate member 12, wherein the first elongate member 11 is formed with an internal surface defined by a first arcuate forward wall 17 of complementary configuration to the external surface of the second arcuate forward wall 18 of the second elongate member 12. The first elongate member includes a first end wall 13 with a second elongate member 12 formed with a second end wall 14 of a generally equally configured perimeter to that of the first end wall. For purposes of illustration, the second end wall 14 is illustrated with a second rear edge 14*a*, with the first end wall provided with a first rear edge 13*a*, each rear edge of a generally vertical orientation relative to a bottom edge formed on each end wall with a respective first and second forward edge 15 and 16 formed on each terminal end of each elongate member of a generally inverted "J" shaped configuration with a respective first and second upper edge 17*a* and 18*a* extending above each respective rear edge 13*a* and 14*a*, but spaced forwardly thereof to provide a trough shaped configuration when the device 10 is positioned adjacent an associated window glass portion "W", as illustrated in FIG. 6 for example. The upper and lower edges 18*a* and 18*b* respectively of a second elongate member is slidingly received within a respective upper and lower channel member 19 and 20 formed to the upper and lower edges of the first elongate member to slidingly receive the second elongate member therewithin. Accordingly, the member may be telescoped as desired to position the device between the window frame portion of the associated window when the device is positioned on an interior window ledge 22, as illustrated in FIG. 6. In this manner, the cold air currents 21 directed downwardly within the so-formed trough are captured therewithin and are heated due to solar and thermal transfer within the environment of the window "W".

Figure 7:
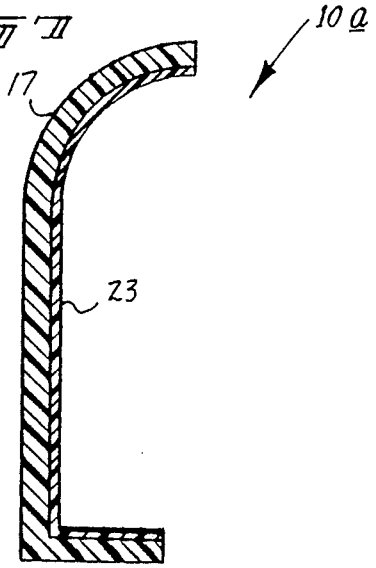
FIG. 7 is an orthographic cross-sectional view of a modification of the instant invention illustrating a mirrored internal surface.
Figure 8:
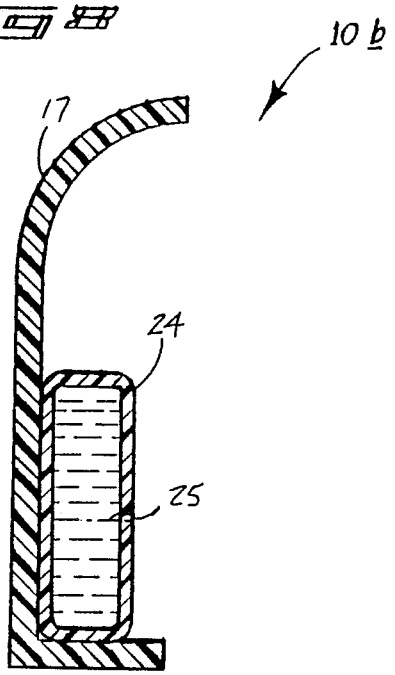
FIG. 8 is an orthographic cross-sectional view of a second modification of the instant invention illustrating an encapsulating envelope containing a gel material therewithin.

FIG. 7 illustrates a second embodiment of the instant invention utilizing a mirrored surface 23 laminated onto the internal surface of each of the first and second elongate members to reflect solar energy directed through the window "W" onto the so-captured air, wherein similarly FIG. 8 is illustrative of an elongate flexible transparent envelope 24 containing a liquid gel material 25 therewithin, wherein the gel material 25 absorbs solar energy through the associated window "W" to enhance heating of the cold air currents directed interiorly of the device when situated adjacent the window "W", as illustrated in FIG. 6.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window insulating device in combination with a transparent window defined by a perimeter frame in surrounding relation to the window and a ledge member projecting coextensively with the lowermost edge of the window and orthogonally relative to the lowermost edge of the window, the device comprising a first elongate member telescopingly receiving a second member, each first and second elongate member including a rear edge positioned adjacent the window within the perimeter frame, and the device defining a trough when positioned on the ledge adjacent the window to capture descending cold air therewithin, and wherein each first and second elongate member includes a respective first and second end wall, wherein each first and second end wall is defined by the respective rear edge, wherein each first and second end wall includes a forward first and second edge defined by a generally inverted "J" configuration, and wherein each first and second elongate member includes a forward wall of a generally inverted "J" shaped cross-sectional configuration, wherein the first and second walls are spaced above and forwardly of a respective rear edge of each respective first and second end wall, and wherein the first elongate member includes an upper and lower channel integrally formed to an upper and lower end edge of the first forward wall for receiving a respective first upper and lower edge within each channel, and wherein the first forward wall is defined by a rear surface of a complementary configuration substantially equal to that defined by a forward surface of the second forward wall, and wherein each interior surface of the respective first and second forward walls includes a respective first and second flexible transparent envelope mounted thereon, the first and second envelope including a heat absorbing gel material therewithin.

* * * * *